350-330 SR
3/24/87 XR 4,652,851

United States Patent [19]
Lewin

[11] Patent Number: 4,652,851
[45] Date of Patent: Mar. 24, 1987

[54] LAMP CONTROL SYSTEM

[76] Inventor: Ian Lewin, 11408 St. Andrew's Way, Scottsdale, Ariz. 85254

[21] Appl. No.: 548,985

[22] Filed: Nov. 7, 1983

[51] Int. Cl.[4] ..... G08G 1/00
[52] U.S. Cl. ..... 340/22; 116/63 R; 350/330; 350/331 R; 340/74; 340/84; 340/94; 340/111
[58] Field of Search ..... 340/40, 94, 111, 906, 340/22, 74, 84; 350/331 R; 116/63 R

[56] References Cited

U.S. PATENT DOCUMENTS

| | | | |
|---|---|---|---|
| Re. 30,355 | 7/1980 | Coffman | 340/40 |
| 1,152,264 | 8/1915 | Aubry et al. | 340/124 |
| 1,625,990 | 8/1925 | Garrett | 340/906 |
| 1,640,170 | 8/1927 | Wright . | |
| 1,640,845 | 8/1927 | Massey . | |
| 1,757,050 | 5/1930 | Johnson . | |
| 2,135,851 | 8/1937 | Sieveking | 116/63 R |
| 2,136,804 | 11/1938 | Paul | 116/63 |
| 2,865,017 | 12/1958 | Heikes | 340/41 |
| 3,289,629 | 2/1964 | Yarger | 340/84 |
| 3,995,954 | 12/1976 | Dir et al. | 350/331 R |
| 4,039,803 | 8/1977 | Harsch | 350/331 R |
| 4,190,343 | 2/1980 | Wagensonner | 350/331 R |
| 4,386,836 | 6/1983 | Aoki et al. | 350/331 R |

*Primary Examiner*—James L. Rowland
*Assistant Examiner*—T. Rittmaster
*Attorney, Agent, or Firm*—LaValle D. Ptak

[57] ABSTRACT

An improved traffic signal lamp control system utilizes continuously burning lamps, such as fluorescent lamps or HID lamps, located inside a traffic signal housing or external to the housing to direct light toward the lens apertures of the housing. A light attentuation device, which may be either a mechanical shutter or a liquid crystal panel is placed in the path of light between the continuously energized lamp and the aperture of the housing to either block the passage of light from the lamp through the aperture or permit the passage of light therethrough. The conventional red, amber and green lenses are placed in the apertures, and the conventional traffic signal light control signals are used to operate the attentuation device. Substantial savings in power consumption are encountered since fluorescent lamps and HID lamps consume much less power than incandescent lamps, and considerably increased lamp life can be achieved. When a liquid crystal shutter is used for the attenuation device, the switching is accomplished by low-voltage switching.

9 Claims, 10 Drawing Figures

LAMP CONTROL SYSTEM

BACKGROUND OF THE INVENTION

A number of applications presently exist for signalling lighting fixtures where the light output is required to be intermittent, or turned on and off. Perhaps the most widely used example is in traffic signal systems, but other examples exist, such as railroad signals, and other forms of flashing lights, "walk/don't walk" signals, and so forth. Intermittent signal lights of these types are almost invariably fitted with incandescent lamps and utilizes various types of switch gear to apply and remove the lamp voltage as desired. In this manner, the lamps are continuously turned on and off by the signalling system with which they are used.

Apart from home applications and purely decorative lighting, the proportion of lighting in the United States which is achieved using incandescent lamps is quite small. The reasons for this relate chiefly to the much higer efficiencies which may be obtained by the use of fluorescent and high-intensity discharge (HID) light sources. The continued use of incandescent lamps is not without merit, since the small light-producing area allows accurate optical control. In addition, incandescent lamps may be dimmed with ease and may be rapidly switched on and off without problems associated with fluorescent and HID light sources. It is this latter capability of incandescent lamps which has made them the widely used choice in intermittent signal light devices, such as traffic signals mentioned above.

Because of the relatively high power consumption of incandescent lamps, however, traffic light signals are becoming increasingly expensive to operate. This has been true, particularly in the most recent past, due to the significantly increased costs of electrical power. The power consumption of a traffic light no longer is negligible and constitutes a significant expense for municipalities operting even relatively small numbers of traffic signal lights.

With recent developments in lamp and electrical technology, the advantages of incandescent lamps for many appications are becoming eroded. HID light sources now may be obtained with approximately the same overall dimensions as incandescent lamps. Furthermore, the miniature HID lamps have light-producing areas roughly equivalent to the size of incandescent filaments. A high degree of optical control can be achieved using certain types of HID lamps, along with the very large gain in lumen output, because optical control possibilities are considerably greater when the light-producing area is small. For example, vehicular headlights traditionally have used incandescent lamps. In underground transportation, however, mine cars now are fitted with high-pressure sodium headlights. Great advantages are achieved, particularly in view of the very high power costs for operating incandescent lamps in mining situations. The small sizes now obtainable in HID lamps permit precise beam control of these lamps on mine cars, where a few years ago, the use of HID lamps in this environment was not practical. Although the initial costs of HID lamps are high, the savings in operation more than justify their use and, over a relatively short period of time, the lower costs of operation result in overall savings in spite of the high initial costs.

In order to employ fluorescent or HID lamps in a traffic signal, however, a means must be available to control and precisely time the on/off light for each signal face. At the present state of technology, it is unusual to switch HID or fluorescent lamps with the frequency required. Electronic devices are available to provide such switching, providing "instant restrike". These devices, however, are quite new and are relatively expensive. In addition, the effect of instant restrike devices upon lamp life and lamp efficiency and reliability is not known. To utilize electronic "instant restrike" control with HID or fluorescent lamps as a substitute for incandescent lamps in present traffic light fixtures, therfore does not appear to be a practical approach at the present time.

If HID lamps or fluorescent lamps can be continuously energized wtih a means for rapidly switching the passing or blocking of light from the lamp through the lens of a traffic signal, for example, significant energy savings in the operation of a traffic light may be accomplished. This results from the high efficiency of fluorescent lamps or HID lamps which produce large quantities of light with very low power consumption. Furthermore, more increased lamp life can be achieved, since fluorescent lamps can operate in excess of 24,000 hours.

Some attempts have been made in the past to provide a traffic signal light system using a continuously burning incandescent lamp. These systems, however, employ non-standard (by today's standards) traffic signal lamp housing to accomplish their purposes. Two U.S. patents which are typical of such systems are the patents to Paul, U.S. Pat. No. 2,136,804, and Heikes, U.S. Pat. No. 2,865,017. These patents disclose motor-driven rotating color discs for changing the color of the light passing through a single light-projecting aperture in each of the four directions controlled by the traffic signal. Both of these patents disclose the use of rotating discs mounted on horizontal axes in front of each of these apertures which move translucent colored panels in front of the apertures to produce the desired colored light projection from the respective apertures. The Paul patent also discloses a drum-type of rotating member mounted on a vertical axis for accomplishing the same purpose. Thus, at any given time, the two opposite apertures have green discs in front of them while the other two opposite apertures mounted at 90 degress to the first two, would have a red disc in front of them. The mechanisms of both of these patents require electric motors and a relatively complex gear arrangement to keep everything rotating and in synchronism.

Two other patents, both older than the Paul and Heikes patents mentioned above, disclose motor-driven vertical drums with different colored sections on them to produce the desired colored light through apertures on the four sides of the traffic signal device disclosed in these patents. Such patents are the U.S. patents to Wright, U.S. Pat. No. 1,640,170, and Johnson, U.S. Pat. No. 1,747,050. Both of these patents disclose the use of pawl and ratchet mechanisms for stepping the rotating drum from one position to another to sequentially place different colored lenses in position between the lamp and the apertures of the traffic light housing. Both of these patents require the use of a motor-driven mechanism to either rotate a cam or some other type of switch device to provide the pulses to the magnetically-operated pawl and ratchet mechanism. Consequently, they are fairly cumbersome and consume substantial amounts of power for the incandescent lamp, solenoid magnets, and clock or timing motors, all of which operate constantly.

Accordingly, it is desirable to develop a switched on and off signalling system which may be used in traffic signal light systems, or the like, which is capable of operation with fluorescent lamps or HID lamps (continuously energized) and which also has a reliable and simple means for attenuating the light passing from the lamp to the lens of such signal.

SUMMARY OF THE INVENTION

Accordingly, it is an object of this invention to provide an improved lamp control system.

Another object of this invention is to provide an improved signal lamp system.

It is an additional object of this invention to provide improved traffic signal lamp system.

It is a further object of this invention to provide an improved signal lamp system utilizing continuously energized lamps with light attenuation devices in the path of light from the lamp through an aperture.

It is a more specific object of this invention to provide an improved traffic signal system using continously energized lamps having low power consumption and switched attentuation devices between the lamps and the lenses of the traffic signal for passing or blocking light from the lamp through the lens in accordance with a pre-established pattern.

In a preferred embodiment of this invention, a lamp control system includes a housing with an aperture in it for permitting light emanating from the lamp to pass through the aperture. A continuously energized lamp is mounted on the housing for directing light toward the aperture. A light attentuation device then is placed in the path of light from the lamp through the aperture in the housing, and the attentuation device is controlled to alter the amount of light passing from the lamp through the aperture in the housing.

In a more specific embodiment, the lamp is mounted inside the housing and the attentuation device is located between the lamp and the aperture.

In another more specific embodiment of the invention, the lamp is mounted outside the housing to direct light toward the aperture and the attentuation device is located in the aperture to block or pass the light from the lamp.

DETAILED DESCRIPTION

Figure 1:
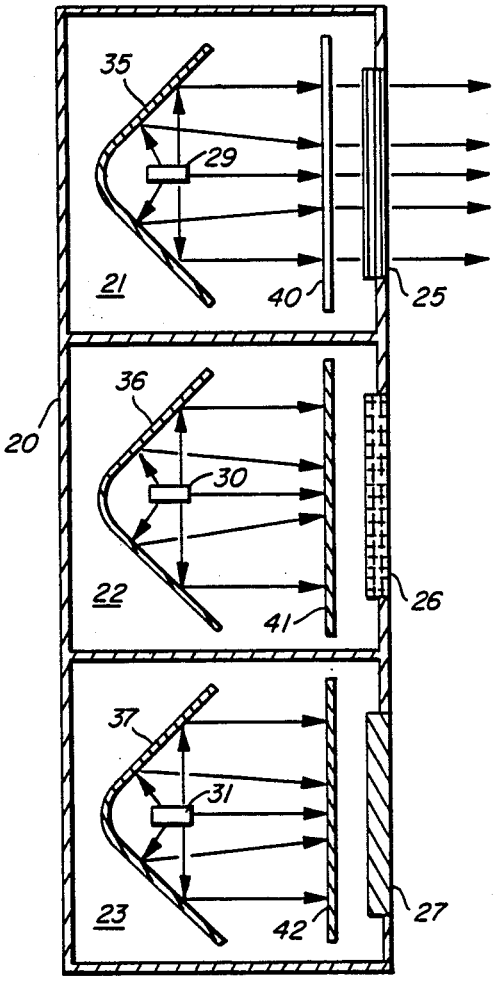
FIG. 1 is a diagrammatic cross-sectional representation of a preferred embodiment.

Reference now should be made to the drawings in which the same reference numbers are used throughout the different figures to designate the same or similar components. One embodiment of the invention is illustrated in FIG. 1. This figure illustrates a traffic signal controlling the red/yellow/green lights for one of the four directions typically encountered in a traffic signal light installation.

In FIG. 1, the signal light is housed in a housing 20 which may be identical to traffic light housings currently in use. Within the housing 20 are three separate compartments, 21, 22, and 23, corresponding, respectively, to the red, yellow (or amber), and green vertically-arranged traffic lights of a typical traffic light signal. The colors are established by the corresponding circular red, yellow, and green lenses 25, 26, and 27, respectively, shown in cross-section in FIG. 1. Light for the lenses is provided by three continuously burning, or continuously illuminated, fluorescent or HID lamps 29, 30, and 31. The source of power for energizing these lamps is not shown in FIG. 1, which illustrates the physical arrangement of the embodiment only.

To facilitate the projection of light from the respective lamps 29, 30, and 31 through the lenses 25, 26, and 27, suitable dish-shaped reflector elements 35, 36, and 37 are located behind the lamps. These reflector elements focus light emanating from the lamps in a generally parallel set of light rays (indicated by the arrows in FIG. 1) through the respective lenses 25, 26, and 27.

Since the lamps 29, 30, and 31 are continuously illuminated, the control of the light passing through the lenses 25, 26, and 27 is effected by means of stationary attenuation devices 40, 41, and 42 for each of the three different compartments. As illustrated in FIG. 1, the attenuation devices are located in fixed positions between lamps 29, 30, and 31, and the lenses 25, 26, and 27. The attenuation devices 40, 41,and 42 either pass or block the light emanating from the lamps 29, 30, and 31, depending upon the state of the different attenuation devices. These devices may be a type of venetian blind shutter, actuated by means of a cam or solenoid, an iris control similar to the type used in camera shutters, or a panal of liquid crystals of the type commonly used for the display panels of LCD watches and the like.

As is well known, liquid crystal devices (LCD) consist of a sheet of oriented particles contained between two layers of glass or plastic. When an electric signal is applied to the liquid cyrstal sheet, the signal renders the entire sheet clear or opaque, as desired. For the purposes of the attenuation devices 40, 41, and 42, shown in FIG. 1, the entire sheet is simultaneously completely opaque or completely clear. When an LCD device is used in conjunction with displays for digital watches, for example, matrices of signals cause different segments of the overall display to be rendered opaque or clear to produce numbers or other symbols in accordance with the signal applications. The use in FIG. 1 as a shutter is more simple to implement.

Thus, in the operation of a traffic signal light system such as shown in FIG. 1, two of the liquid crystal panels 40, 41 and 42 are opaque at any given time, while one is clear or transparent, to permit the light associated with the lamp and lens in the compartment containing such a clear crystal panel to pass from the lamp trough the corresponding lens. For the two opaque liquid crystal attenuation devices, the devices block the passage of light from the continuously illuminated corresponding lamp to its associated lens. The resultant effect, for the vehicle operator relying upon the traffic signal light, is a display which resembles in every respect the conventional switched incandescent displays currently in widespread use.

Figure 2:
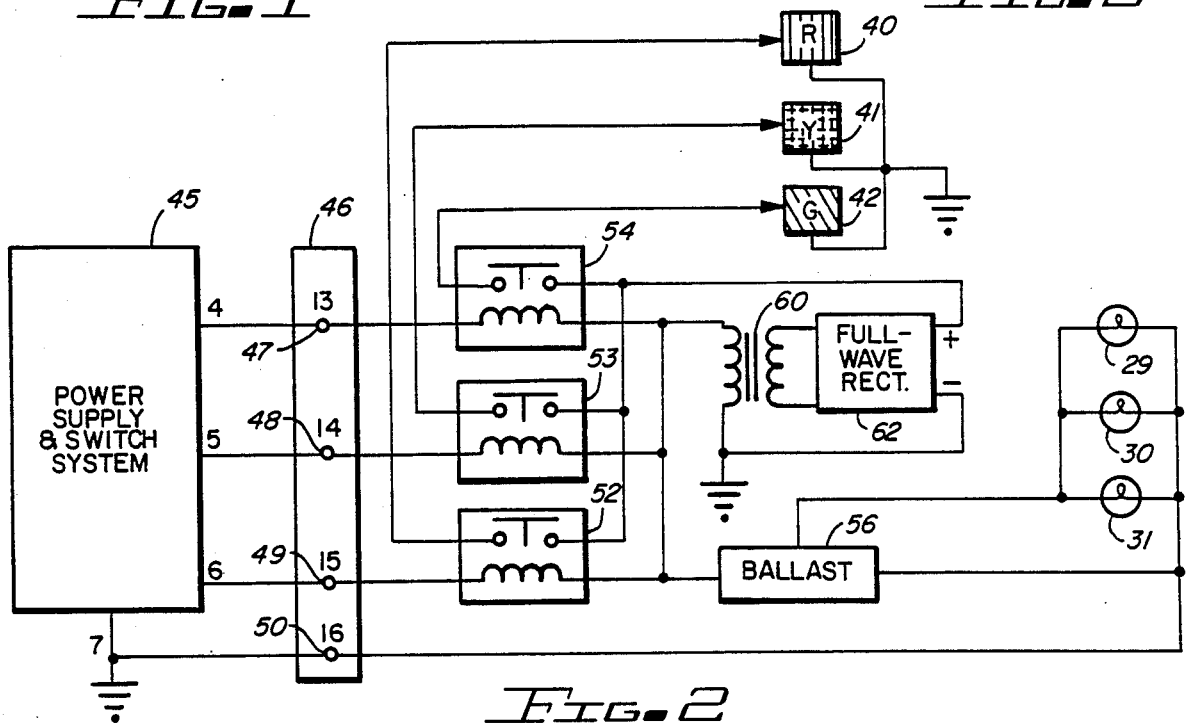
FIG. 2 is a block diagram of a circuit for operating the device shown in FIG. 1.

FIG. 2 is a schematic diagram of a system which is used to provide operating power to the lamps 29, 39, and 31, and also to provide the operating signals to the liquid crystal attenuation panel devices 40, 41, and 42. The control of the system shown in FIG. 1 is effected from the conventional traffic light control signals obtained from a power supply and switch system 45 of the type currently used to supply the operating and control signals to conventional traffic lights. As a consequence, substitution of a traffic signal lamp control system of the type shown in FIG. 1 for the conventional systems currently in use requires no changes to the power supply and switch system normally associated with standard traffic signals. The signals from the power supply and switch system 46 are applied through a terminal strip or connecting device 46, which interfaces the power supply and switch system 45 with the control circuit portion of the system.

To replace a traffic signal using a conventional switched incandescent bulb arrangement with the design shown in FIG. 1, the old traffic signal is simply disconnected at the terminal connection points 47, 48, 49, and 50, with the control system illustrated in FIG. 2 to the rigt of these points then being substituted or plugged into these points. The new system includes three switching relays, 52, 53, and 54 associated respectively with the attenuator panels 40, 41, and 42 used to permit passage of or to block passage of light from the continuously illuminated lamps 29, 30, and 31 through the respective red, yellow, and green lenses 25, 26, and 27.

The right-hand ends of the coils of all of the switching relays 52, 53, and 54 are connected together in common to a lamp ballast 56, which in turn is connected to the three lamsp 29, 30, and 31 to operate the lamps. For fluorescent lamps, a ballast 56 is used. For other types of lamps, such as HID lamps, a similar electrical component is used to operate the lamps. The particular interconnections of the ballast 56 with the lamps 29, 30, and 31 is not important, since this is a standard connection for the operation of the particular type of lamp which is used. As is well known, a separate ballast (such as ballast 56) normally is required for each lamp 29, 30 and 31; so that the ballast 56 shown is merely illustrative of a variety of different standard circuits. Consequently, whenever a voltage or current is applied through any one or more of the terminals 47, 48, or 49, the lamps 29, 30, and 31 are continuously energized irrespective of which one of the relays 52, 53, and 54 are operated. Consequently, continuous lamp energization is achieved.

In the event that the existing conventional switch gear in the power supply and switch system 45 causes a momentary break in voltage when switching from one to another of the terminals 47, 48, and 49, a capacitor may be connected in the circuit to ensure that such momentary interruptions do not cause extinguishing of any of the lamps 29, 30, and 31.

A transformer 60 is connected in parallel with the lamp and ballast circuit, and thus has a continuous alternating current voltage applied to its primary winding to produce a similar continuous alternating voltage at the secondary winding. The secondary winding is connected in turn to the input terminals of a full-wave rectifier circuit 62. When the attenuation devices 40, 41, and 42 are liquid crystal panels, the voltage produced by the full-wave rectifier circuit 62 is a low direct voltage applied in common to the left-hand terminal of the switches associated with each of the coils of the switching relays 52, 53, and 54. The left-hand terminals (as shown in FIG. 2) of the switches of the switching relays are connected respectively to the liquid crystal panels 40, 41, and 42 associated with the red, yellow, and green lenses or light positions of the traffic light of FIG. 1.

The electrical interconnections of the attenuation panels 40, 41, an 42 are such that, whenever the associated switch contacts of the switching relays 52, 53, and 54 are open, the associated liquid crystal attenuation device is opaque, or blocks the passage of light through it. Whenever any one of the switch contacts of the switching relays 52, 53, or 54 is closed by the relay coil in that switching relay, the application of the operating potential to the corresponding liquid crystal attenuation device 40, 41, or 42 is such that the liquid crystal device to which such voltage is applied becomes clear or transparent to permit light from the associated lamp to pass through it to the corresponding one of the lenses 25, 26, or 27.

Figure 3:
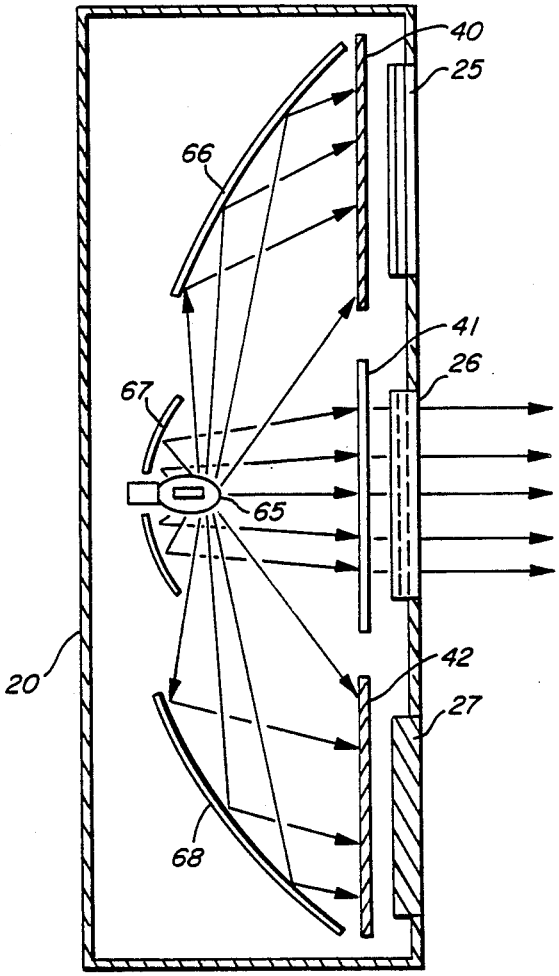
FIG. 3 is a diagrammatic cross-sectional view of another embodiment of the invention.

FIG. 3 illustrates another embodiment of the invention which employs only a single lamp 65 and appropriately spaced reflector elements 66, 67, and 68 to direct light emanating from the lamp 65 through each of the liquid crystal attenuation panels 40, 41, and 42, and therethrough to the corresponding lenses 25, 26, and 27. The operation of the signal device shown in FIG. 3 is the same as the one shown in FIG. 1 so far as the interconnections between the various elements and the circuit of FIG. 2 is concerned, with the exception that the single lamp 65 replaces the three lamps 29, 30, and 31 shown in the circuit of FIG. 2. In all other respects, the system operates in the same manner described previously in conjunction with FIGS. 1 and 2.

Figure 4:
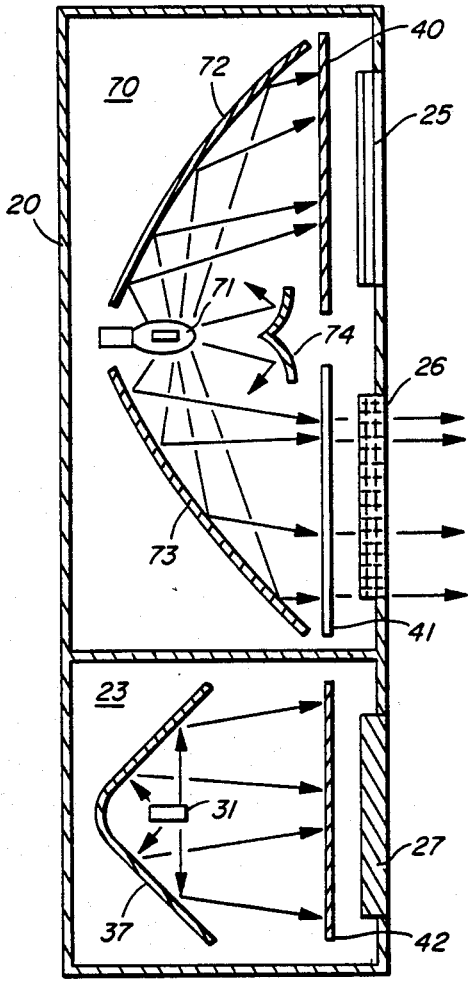
FIG. 4 is a diagrammatic cross-sectional representation of a third embodiment of the invention.

Reference now should be made to FIG. 4, which shows a traffic light signal of the general type of FIG. 1 but divided into two compartments instead of the three of FIG. 1. In FIG. 4, the lower compartment 23 corresponds in all respects to the same arrangement in the lower compartment 23 of FIG. 1. A single upper compartment 70 is employed with a single HID lamp 71 located in it for illuminating the red and yellow lenses. Appropriate reflectors 72, 73 and 74 are used to direct and maximize the focusing of the light emanating from the lamp 71 onto the LCD panels 40 and 41 interposed between the light emanating from the lamp 71 and the lenses 25 and 26. The operation of the system as a traffic light system is the same as described previously in conjunction with FIGS. 1 and 2. The system of FIG. 4, particularly when used with HID lamps or with fluorescent lamps, is capable of obtaining far more efficient utilization of the light by selecting lamps 71 and 31 in the range of the color spectrum to be passed through the corresponding lenses 25 and 26 for the lamp 71, and the lens 27 for the lamp 31.

To achieve a certain color, as observed by a driver or pedestrian, the color filter (that is, lens 25, 26, or 27) which must be used eliminates a large quantity of the radiant energy. For example, if a lamp produces white light but produces only 19% of its radiant energy in the green area of the spectrum, to produce the required green chromaticiity, 81% of the light emitted must be absorbed by the green colored filter. In the present example, this is the lens 27 in the lower compartment 23 of the housing 20.

In the case of fluorescent or HID lamps, however, radiant energy is contained in specific emission bands at certain fixed wave lengths. The intensity and location of the wave length bands in the spectrum are dependent upon the type of lamp used. By proper selection of the lamp type, HID or fluorescent lamps can be chosen which have a powerful spectral emission band at or close to the desired signal color. For example, a high-pressure sodium discharge lamp has a very strong emission in the yellow and red areas of the spectrum, with little radiation elsewhere. Thus, for the lamp 71 of the embodiment shown in FIG. 4, if a high-pressure sodium lamp is used to light the red and yellow sections of the traffic signal (provided by the red lens 25 and yellow lens 26), little color filtering is required, as compared to an incandescent lamp, in order to achieve the specified chromaticity for the signal face. The already high efficiency differential between incandescent and high-pressure sodium lamps, therefore, is multiplied. This further improves the projected operating cost savings of a traffic signal system of the type disclosed here.

Certain lamp types can be made in a variety of colors. High efficiency fluorescent phosphores are available for green, yellow, and to a lesser extent, red, and little secondary color adjustments by filters may be required. If, for example, a color filter or lens of 80% transmittance can be employed rather than one of 20% transmittance because the inherent lamp color is close to ideal, than four times the amount of lamp lumens will be emitted. Conversely, approximately one-quarter of the wattage is required to operate such a lamp for equal lumen delivery, all other factors being equal. In addition, if the fluorescent lamp is four times more efficient in producing its light than an incandescent lamp of the type formerly used, the overall possible increase in light output becomes a factor of sixteen times that previously available from an incandescent lamp for the same amount of input power or energy consumption. Stated another way, for equal lumens of projected light, one-sixteenth of the wattage is required to operate a system of the type shown in FIG. 4. Even if the lamps burn continuously in several optical chambers, the overall power savings are substantial.

Similar possibilities arise with the use of HID lamps in the various embodiments which are shown in the drawing. For example, metal halide lamps can be manufactured to produce a variety of brilliant colors by the adjustment of the proportions of the various types of salts in the discharge tube which control the location and power of the emission bands in the wave length spectrum. Lamps have been manufactured in several colors by the use of cesium, thallium, indium, and sodium iodites.

Figure 5:
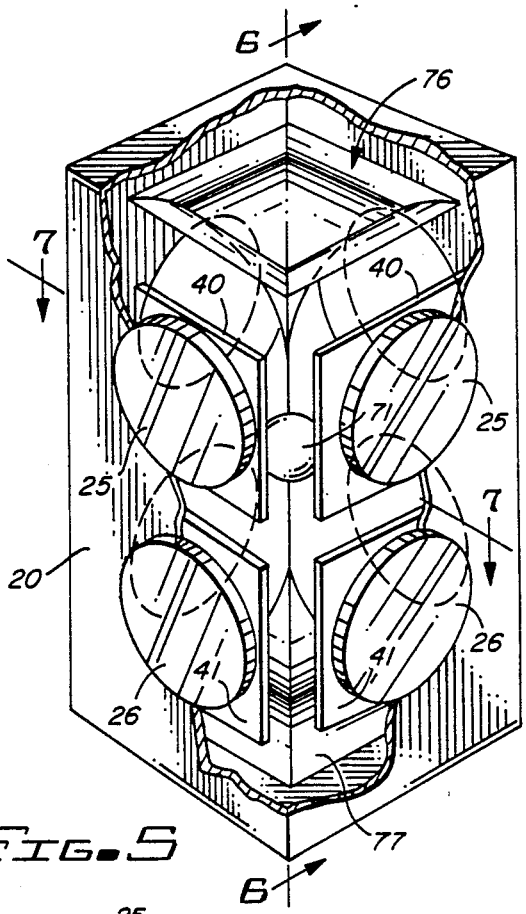
FIG. 5 is a partially cut-away perspective view of another embodiment of the invention.
Figure 6:
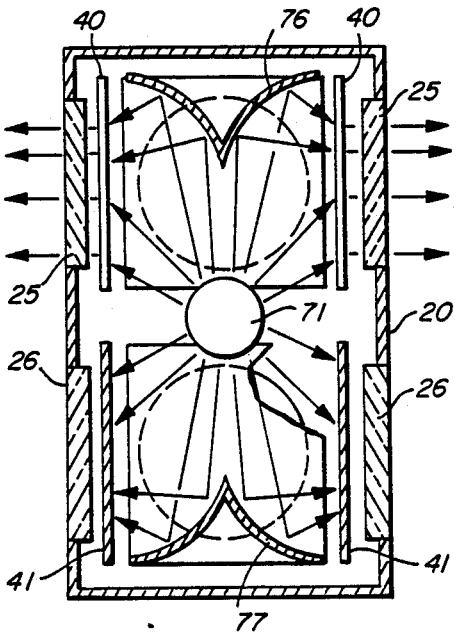
FIG. 6 and 7 are vertical and horizontal cross-sectional views, respectively, of the embodiment shown in FIG. 5.
Figure 7:
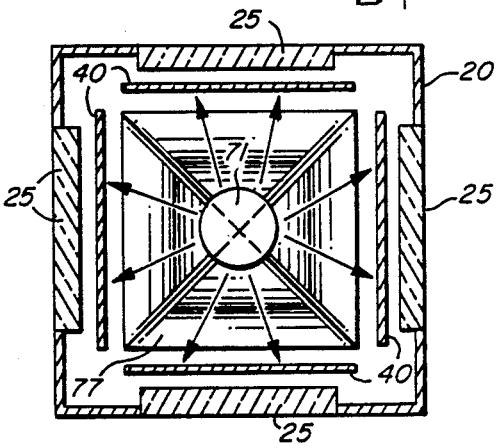

Reference now should be made to FIGS. 5, 6, and 7 which illustrate an embodiment which employs a single lamp for multiple (as shown in FIG. 4) signal face systems. In the embodiments shown in FIGS. 1, 3, and 4, the lamps are utilizied with only a single face or direction of a traffic signal light, or the like. The housing 20 shown in FIG. 5 is comparable to the upper compartment 70 of the housing of FIG. 4. It differs, however, by virture of the placement of the lamp 71 at a location in the center of the housing. The support for the lamp 71 has not been shown, since it may be effected in a variety of conventional ways. The lamp 71 is continuously illuminated by a system of the type illustrated in FIG. 2.

FIG. 6 is a vertical cross-section of the embodiment shown in FIG. 5, and FIG. 7 is a horizontal cross-section. An upper reflector 76 in the top of the housing 20 and a lower reflector 77 in the bottom are employed to re-direct light rays from the lamp 71 which radiate toward the top and the bottom of the housing outwardly through the various lens openings or apertures on all four sides of the housing 20, as illustrated most clearly in FIG. 6. Chambers or housings of the type shown in FIGS. 5, 6, and 7 may be stacked vertically in pairs with a single source lighting many chambers, or in any of a variety of arrangements to produce the desired effects. The reflector configurations used are those which direct the light to the apertures in which the lenses 25, 26, and 27 are located and may be of a variety of configurations to achieve this result. The lamps, such as the lamp 71, may be positioned vertically or horizontally. If they are positioned horizontally, they may be used with their axes parallel to or perpendicular to the traffic flow. The particular arrangement which is used in any given situation is selected to provide the optimum lighting conditions for the particular location or use planned for the signal light.

Figure 8:
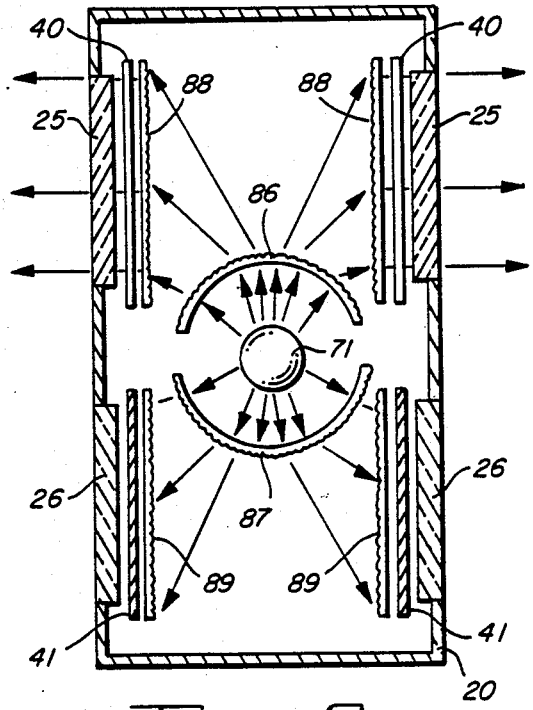
FIG. 8 is another embodiment of the invention.

FIG. 8 is a cross-sectional view of an embodiment for a four-way or four-direction lamp of the type generally shown in FIGS. 5, 6 and 7. FIG. 8 is comparable to the cross-section of FIG. 6, but instead of using reflectors such as the reflectors 76 and 77, refractive optics are used to direct the light in the desired directions. This is accomplished by using upper and lower semi-spherical optical refractors 86 and 87, along with vertically-oriented refractors or lenses 88 and 89 to direct the light rays outwardly through the apertures in which the lenses 25 and 26 are located on each of the four faces. Thus, the refractive elements 86 and 87 nearly fully surround the lamp and intercept the angular rays of the output of the lamp 71 and redirect the rays toward the signal face. The lenses 88 and 89 behind the signal faces then refract the rays to the desired direction of emission outwardly through the lenses 25 and 26 in all four directions.

Figure 9:
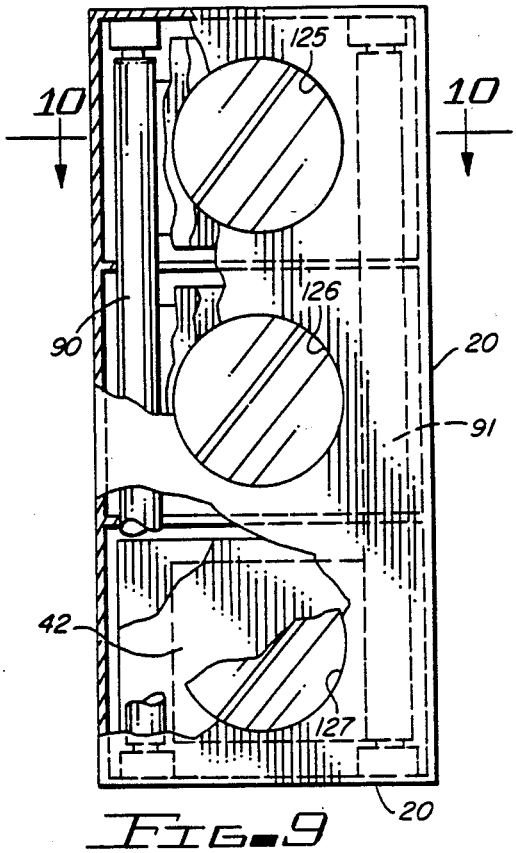
FIG. 9 is a partially cut-away side view of still another embodiment of the invention.
Figure 10:
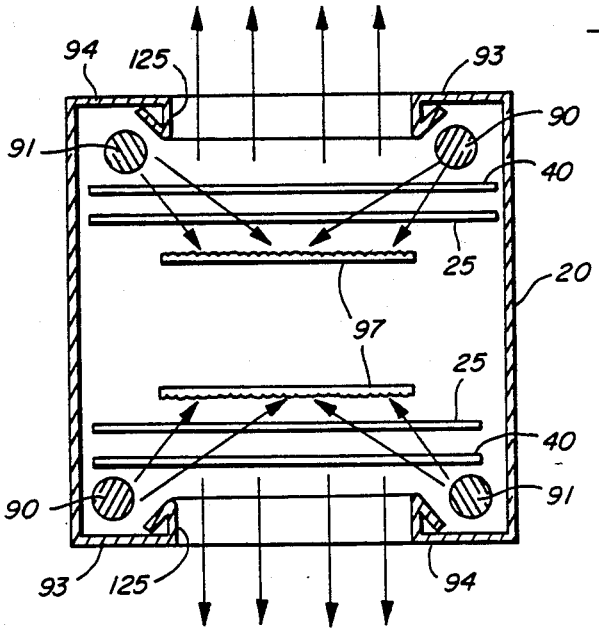
FIG. 10 is a cross-sectional view taken along the lines 10—10 of FIG. 9.

FIGS. 9 and 10 disclose still another arrangement which is ideally suited for the use of elongated fluorescent light tubes as the light source. In the embodiment shown in FIGS. 9 and 10, however, the lamp or light source is not placed inside the housing, but instead is located on the outside of the housing external to the various lens faces for the traffic light signal. Reflected light then is utilized to select or designate the particular lens aperture to be "illuminated" at any given time. The system of FIGS. 9 and 10 overcomes a disadvantage which is inherent in all presently-known traffic signal light systems. When intense sunlight is directed toward a traffic signal light face, frequently, the reflections from the sunlight are so much brighter than the light from within the traffic light signal that it is difficult for motorists to tell which of the three lights is illuminated. In the past, the solution to this problem has been to provide shaded hoods or the like over each of the lens apertures and to use the highest intensity lamps necessary to overcome the effects of the sunlight. The system shown in FIGS. 9 and 10, however, is enhanced in its operation in bright sunlight. In fact, in bright sunlight, under some conditions, it is possible to turn off or reduce to a very low level the light output from the lamps used in the system.

To understand how the system of FIGS. 9 and 10 operates, reference now should be made to these figures. The housing 20 is comparable to the housing of FIG. 1 or FIG. 3, for example. The lamp sources and reflectors shown inside the housings of FIGS. 1 and 3, however, are not used. Instead, each of the signal faces has two vertically-oriented fluoresent light tubes 90 and 91 along each edge of the housing and located behind reflector covers 93 and 94, respectively, which simply constitute extensions of the housing 20. This is shown most clearly in FIG. 10. As can be seen from FIG. 10, the shape of the reflector covers 93 and 94 prevents the fluorescent lamp tubes 90 and 91 from being directly observed by a motorist or persons viewing the traffic light.

The arrangement of the signal light system of FIGS. 9 and 10 also differs from those of the other embodiments described previously inasmuch as the aperture itself, which is on the outside of the housing for each of the signal light openings, does not have a lens in it. Instead, the apertures 125, 126 and 127 are holes through the outside of the housing. Behind the apertures and also located behind the position of the fluorescent bulbs 90 and 91, are the liquid crystal attenuation panels 40, 41, and 42. This arrangement is shown most clearly in FIG. 10. Thus, light impinging upon the panels 40, 41, and 42 from the bulbs 90 and 91 or from sunlight, is either blocked by the panels 40 (and therefor, appears dark or black) or is permitted to pass through the panels 40. The circuit shown in FIG. 2 also is used to operate the system of FIGS. 9 and 10 as the same manner described previously in conjunction with other embodiments of this invention.

The colored lenses 25, 26, and 27 for each of the three different compartments of the traffic signal light system shown in FIG. 9 are located behind the attenuator panels 40, 41, and 42, respectively. Once again, this is shown most clearly in FIG. 10. To complete the apparatus and to project light outwardly through the open apertures 125, 126, or 127, reflectors 97 are then placed at the innermost position in each of the three compartments for the signal light, as indicated in FIG. 10. The reflectors 97 reflect the light received through the attenuator devices 40, 41, and 42 and the corresponding lenses 25, 26, and 27 back through the lens to create the appearance of a lighted signal in the respective apertures 125, 126, and 127.

The configuration of the reflectors 97 is selected to be such that light is re-directed preferentially over the range of angles required for the given signals. This can be achieved by a series of vertically extending ribs, each rib having a cross-sectional curvature which is optically designed and controlled to create the desired light distribution. Vertically extending ribs produce a desired light distribution laterally about the traffic signal. An alternative solution is to use reflective elements in the form of dimples, with the curvature of the dimples designed to produce preferred light distribution in both vertical and lateral planes.

It is apparent, from a consideration of the embodiment shown in FIGS. 9 and 10, that the effect of sunlight does not produce phantom images of the type which are a problem with conventional traffic light signals. Phantom signals are those where a signal appears to be lighted when, in fact, it is not lighted. The placement of the attenuators 40, 41, and 42 immediately behind the apertures 125, 126, and 127 blocks the sun's rays, as well as the rays of light emanating from the bulbs 90 and 91 whenever the panels 40 are in their opaque condition of operation. When the corresponding attenuator panels 40, 41, or 42 for any of the signal light positions is switched to its clear or light transmission state of operation by the circuit of FIG. 2, an additional benefit occurs. That is, if bright sunlight shines on the face of the signal, it enhances the light output which appears to be produced through the corresponding aperture 125, 126, or 127. In fact, it is possible to design the system to reduce the power supplied to the lamps 90 and 91 during times of moderate-to-high sunlight and simply utilize the sunlight to produce the reflected light viewed through the desired aperture of the signal light system. Consequently, the system may be fitted with photocell detectors to determine the level of sunlight incident upon the traffic signal housing in the plane of the signal face but shielded from the lamps 90 and 91 to monitor the sunlight level. This photocell then is used to control the light level from the lamps 90 and 91 by using known dimming circuitry. Consequently, a balance may be created between the beneficial sunlight effect and the contribution from the external lamps 90 and 91 to produce a continuous satisfactory level of reflected light from the system.

In all of the foregoing embodiments using a liquid crystal attenuator panel, it is possible to fabricate the panel as a matrix of groups of liquid cyrstals in which each crystal of a group is separated from others of the same group by liquid crystals of other groups. Then by selectively controllig the signals applied to the different groups, the panel may be operated as a dimming device without causing any color shift in the light transmitted through it.

The foregoing embodiments which have been described in conjunction with the various figures of the drawings should be considered as illustrative of the invention only, and not as restrictive of the concepts of the invention. Various changes and modifications will occur to those skilled in the art without departing from the true scope of the invention. For example, a variety of different reflector arrangements may be used. Also, various configurations of the bulb arrangements may be employed in addition to the ones which have been enclosed without departing from the true scope of the invention as defined in the claims.

I claim:

1. A traffic signal light control system, including in combination:

a housing with at least one set of three vertically aligned apertures in it corresponding to different light positions of a traffic signal light for permitting light emanating from a lamp to pass through the apertures;

at least one continuously energized lamp mounted on said housing for directing light toward said apertures;

separate, independently operated shutter means for each of said apertures, each of said shutter means having open and closed conditions of operation and each mounted in a fixed stationary position in the path of light from said lamp through each of said apertures in said housing; and control means coupled to each of said shutter means for controlling the condition of operation thereof individually and independently of the others of said shutter means to alternately pass and block light from said lamp through each of said apertures in said housing.

2. The combination according to claim 1 wherein said control means switches said shutter means from a state blocking the passage of light therethrough to a state permitting the passage of light therethrough and vice versa.

3. The combination according to claim 2, wherein said lamp is mounted inside said housing.

4. The combination according to claim 1, further including a colored lens element in each of said apertures.

5. The combination according to claim 1 wherein said lamp is a single lamp which directs light toward more than one of said apertures.

6. A traffic signal light control system, including in combination:

a housing with at least one set of three vertically aligned apertures in it corresponding to different light positions of a traffic signal light for permitting light emanating from a lamp to pass through the apertures;

at least one continuously energized lamp mounted outside said housing to direct light toward said apertures;

separate shutter means for each of said apertures, each of said shutter means having open and closed conditions of operation in the path of light from said lamp through each of said apertures in said housing; and control means coupled to each of said shutter means for individually and independently controlling the operation thereof to alternately switch said shutter means from a state blocking the passage of light therethrough from said lamp to a state permitting the passge of light therethrough and vice-versa.

7. The Combination according to claim 6, further including a colored lens and a reflector associated with each of said apertures, wherein said shutter means, said colored lens, and said reflector are mounted in each aperture in said housing with said shutter means nearest said lamp means on the outside of said apertures, said colored lens is mounted behind said shutter means, and said reflector is mounted behind said colored lens inside said housing.

8. The combination according to claim 7, wherein each of said shutter means comprises a liquid crystal panel having at least two states of attentuation, one of which blocks the passage of light therethrough, and the other of which is substantially transparent to the passage of light therethrough, and said control means comprises a separate electric switching circuit connect to each of said liquid crystal panels for switching the state of each of said panels from one state to the other.

9. A traffic signal light control system including in combination;

a housing with at least one set of three vertically aligned apertures in it corresponding to different light positions of a traffic signal light for permitting light emanating from a lamp to pass through the apertures;

at least one continuously energized lamp mounted on said housing for directing light toward said apertures;

separate shutter means comprising a liquid crystal panel for each of said apertures, each of said liquid crystal panels having at least two states of attenuation, one of which blocks the passing of light therethrough, and the other of which is substantially transparent to the passage of light therethrough, each of said panels located in the path of light from said lamp through corresponding ones of said apertures in said housing; and an electric control circuit connected to said liquid crystal panels for individually and independently switching the state of each liquid crystal panel from one state to the other to alternately pass and block light from said lamp through each of said apertures in said housing.

* * * * *